US006152012A

United States Patent [19]

Sherwood

[11] Patent Number: 6,152,012

[45] Date of Patent: Nov. 28, 2000

[54] AMMUNITION CONTAINER BRACKET FOR MACHINE GUN

[75] Inventor: Patrick Sherwood, Wharton, N.J.

[73] Assignee: The United States of America as represented by the Secretary of the Army, Washington, D.C.

[21] Appl. No.: 09/210,527

[22] Filed: Dec. 3, 1998

[51] Int. Cl.[7] ..... F41A 9/00

[52] U.S. Cl. ..... 89/33.4; 89/33.14; 89/33.2

[58] Field of Search ..... 89/33.1, 33.14, 89/33.2, 33.5, 33.16, 34, 33.25, 33.4; 42/49.01, 50

[56] References Cited

U.S. PATENT DOCUMENTS

| | | | |
|---|---|---|---|
| 3,293,986 | 12/1966 | Stoner | 89/34 |
| 4,112,817 | 9/1978 | Bourlet | 89/33 |
| 4,676,138 | 6/1987 | Thompson et al. | 89/33.14 |
| 4,753,155 | 6/1988 | Balister | 89/34 |
| 4,901,463 | 2/1990 | Chesnut | 42/50 |
| 4,942,802 | 7/1990 | Stoner | 89/191.01 |
| 5,117,735 | 6/1992 | Flashkes | 59/33.14 |

*Primary Examiner*—Charles T. Jordan
*Assistant Examiner*—Michelle Thomson
*Attorney, Agent, or Firm*—John F. Moran; Michael C. Sachs

[57] ABSTRACT

A device for use with a weapon having a magazine well for acceptance of a first munitions magazine of a given capacity. The device includes a bracket having first end sized to replicate the well engaging end of the munitions magazine to permit insertion of the bracket into the well and a second end on the bracket for engagement with a second munitions magazine having a substantially greater munitions capacity than the first magazine. Insertion of the bracket into the well and the second munitions magazine into the bracket permits firing of the full capacity of the second munitions magazine. The preferred weapon for this invention is Model M249 Squad Automatic Weapon ("SAW") or other similar weapons, wherein the first magazine is a 30 round magazine and the second magazine is selected from 100 round and 200 round magazines. The M249 SAW is designed to be carried for use while the operator is standing and also provided with a tripod device for ground mounted emplacement and use.

6 Claims, 2 Drawing Sheets

AMMUNITION CONTAINER BRACKET FOR MACHINE GUN

The invention described herein may be manufactured, used, and licensed by or for the U.S. Government for government purposes.

FIELD OF THE INVENTION

The present invention relates to an ammunition bracket for the Model M249 Squad Automatic Weapon ("SAW"). More particularly the invention relates to a bracket that permits attachment of 100 and 200 round ammunition containers to the weapon.

BACKGROUND OF THE INVENTION

The M249 SAW is a versatile weapon that normally employs a 30 round magazine for field use. Because it is an effective weapon, it is often times deployed in a position where the potential for extended or extremely rapid firing over short periods would be required.

The difficulty in stacking and replacing a large number of 30 round magazines, along with the intermittent halting of firing at what might be an inopportune time, prevents this weapon from being as effective as its potential suggests. The M249 SAW is also effective in ground mounted emplacements. Again it is difficult to achieve maximum firepower when 30 round magazines must be replaced. It would be a great advance if a way could be provided to increase the firing capacity of the M249 SAW and similar weapons.

It would also be an advantage if a larger quantity, such as 100 or 200 rounds could be fired by such weapons, especially when deployed in ground mounted emplacements, and particularly with tripod usage.

Accordingly, one object of the present invention is to provide a means for enabling weapons such as the M249 SAW to have increased munitions capacity.

Another object of this invention is to provide a simple, effective device for increasing the firing capacity of weapons normally employing magazines of more limited capacity.

A specific object of this invention is to provide a bracket for use in place of the conventional 30 round magazine, for insertion into the same well as currently provided for that magazine in the weapon, which bracket dramatically increases firing power capacity by enabling the use of otherwise available, conventional 100 or 200 round magazines not currently useable for this weapon.

Other objects will appear hereinafter.

SUMMARY OF THE INVENTION

It has now been discovered that the above and other objects of the present invention may be accomplished in the following manner.

Specifically, the present invention comprises a device for use with a weapon having a magazine well for acceptance of a first munitions magazine of a given capacity. The device, a bracket of the size of the first munitions magazine, is provided with a first end sized to replicate the well engaging end of the munitions magazine to permit insertion of the bracket into the well. The bracket also has a second end thereon for engagement with a second munitions magazine having a substantially greater munitions capacity than the first magazine.

Insertion of the bracket into the well and the second munitions magazine into the bracket permits firing of the full capacity of the second munitions magazine.

The device is useful with weapons that are designed to be carried by an operator who is able to discharge the weapon accurately, firing the full capacity of the first munitions magazine. The preferred weapons are also designed to be used in ground mounted emplacements where larger magazines are used to increase firepower in a fixed location. Typically, the larger magazines make it difficult to accurately fire the weapon due to the weight and size of the larger magazine. In addition, the use of larger magazines takes up more space than is available with some mounting means such as bipod mounts.

The preferred weapon is the M249 SAW, wherein the first magazine is a 30 round magazine and the second magazine is selected from 100 round and 200 round magazines. The M249 SAW is designed to be carried for use while the operator is standing and also provided with a tripod device for ground mounted emplacement and use.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
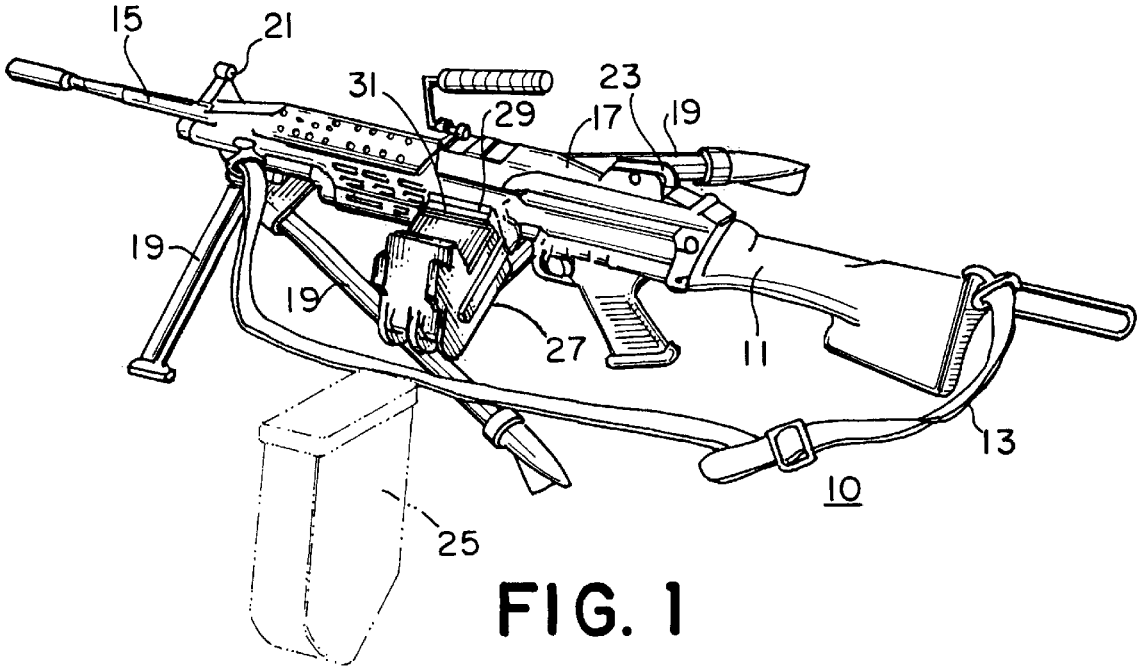
FIG. 1 is a perspective view of the device of this invention shown in cooperation with a typical weapon for which the invention is intended.

The present invention has many advantages over the prior art. Referring to FIG. 1, the device, 10 generally, includes a weapon 11 such as the M249 SAW illustrated in FIG. 1. Weapon 11 includes a sling and snaphook assembly 13 to permit the operator to carry and use the weapon while standing. The barrel assembly 15 and cover/feed mechanism assembly 17 complete the description of weapon 11.

When the weapon 11 is used in a ground mounted emplacement, tripod assembly 19 for use on the ground. Front sight 21 and rear sight assembly 23 permits accurate use in this ground mounted emplacement. A larger magazine 25 is used in this second orientation. Second magazine 25 is inserted for use into weapon 11 via bracket 27, which, as described below, is inserted into the magazine well 29 by lifting door 31. normally closed, and a 30 round magazine, not shown, is inserted.

The cartridges contained in this weapon magazine are on a cartridge belt, and the lead bullet is inserted into the weapon's feed mechanism 17 and rounds of ammunition are fed into weapon 11 in the conventional way. When adapter bracket 27 is in use, the larger magazine is supported to permit the cartridge belt to be pulled into the weapon as it is fired, either one round at a time or in bursts of weapon fire.

Figure 2:
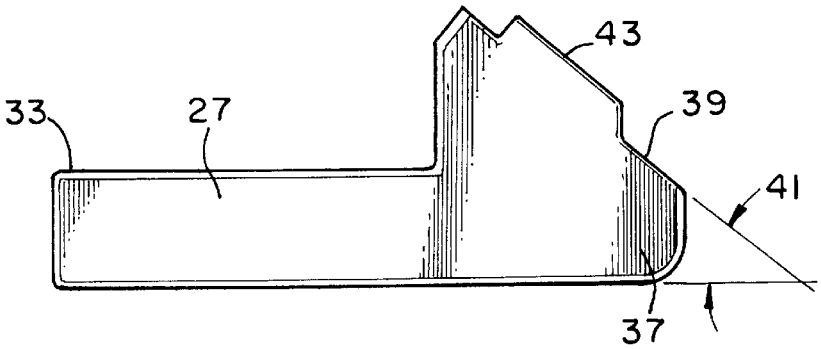
FIG. 2 is a side elevational view of the device of this invention apart from the weapon shown in FIG. 1.

Turning now to FIG. 2, the details of adapter bracket 27 are illustrated. Specifically, adapter bracket 27, normally made from aluminum, is ridged and sufficiently strong to support a full 200 round ammunition magazine. However, when subjected to heavy use in the field, bracket 27 is intentionally designed to break before the weapon well 29 or any of the other parts of the weapon. This is done to permit a relatively inexpensive aluminum part to be sacrificed rather than damage a much more expensive weapon such as the M249 SAW.

Figure 5:
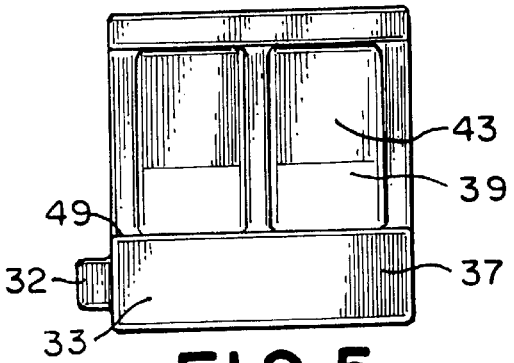
FIG. 5 is an end view of the device

Adapter bracket 27 includes a first end 33 for insertion into well 29 after door 31 has been lifted, wherein first end 33 replicates the end of a first magazine (such as a 30 round magazine that is capable of delivering a reasonable number of rounds without rendering the gun awkward or difficult to use) normally used with the weapon 11. The dimensions of first end 33 are the same as that of conventional 30 round magazines, namely a rectangular opening that engages the feed mechanism assembly 17. Guide 32, shown in FIGS. 3 and 5, is positioned on one side of bracket 27 to align the bracket 27 as it slides into magazine well 29.

Figure 3:
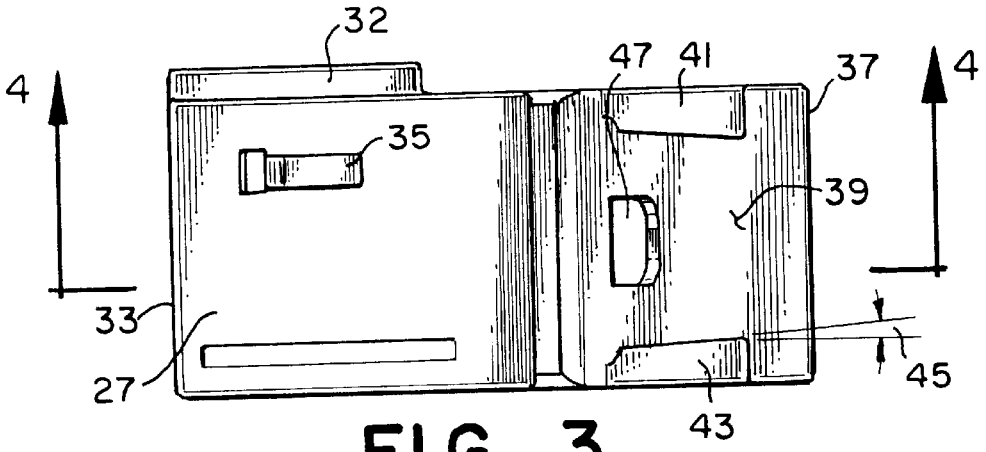
FIG. 3 is a plan view showing the top of the device of FIG. 2.

As is better seen in FIG. 3, first end 33 also includes a slot 35 which is positioned to engage a catch, not shown, on spring-held, normally closed door 31 of the weapon, so that the catch of door 31 and slot 35 locate and maintain the position of the bracket 27. When it is desired to be removed, door 31 is once again lifted up further than its spring biased engagement with slot 35, and bracket 27 is pulled out of well 29.

Second end 37 of bracket 27 is rounded and presents face 39 at an angle 41 designed to permit the 200 round magazine to be upright when attached to the bracket. Typically, the angle will be about 40°, more or less, as it has been determined that this angle gives the best orientation of the magazine 25 to permit feeding of the cartridge belt into the feed mechanism of the weapon with fewest problems. Along with face 39 are a pair of tapered, dove-tail slides 43 which cooperatively engage slots on the larger magazine 25. Tapered slides 43 are tapered at angle 45 of about 5° to permit quick engagement in the field without the problems involved with jamming from sharper angles and also without difficulty in alignment if no taper was provided.

Also provided on face 39 is a slot 47 which, when the magazine 25 is inserted on to slides 43, engages a catch, not shown but conventional on all larger magazines, so that slot 47 further provides stability so that the cartridge belt feeds smoothly from magazine 25 into feed mechanism 17. In order to further maintain the proper alignment and ease of feeding cartridge belts into the weapon, face 39 is raised to begin at point 49, which is spaced from face 51 of the body of adapter bracket 27. This distance is necessary to properly align the face 39, along with slides 43, with standard magazine dimensions while also allowing first end 33 to engage the weapon's conventional magazine well 29.

Figure 4:
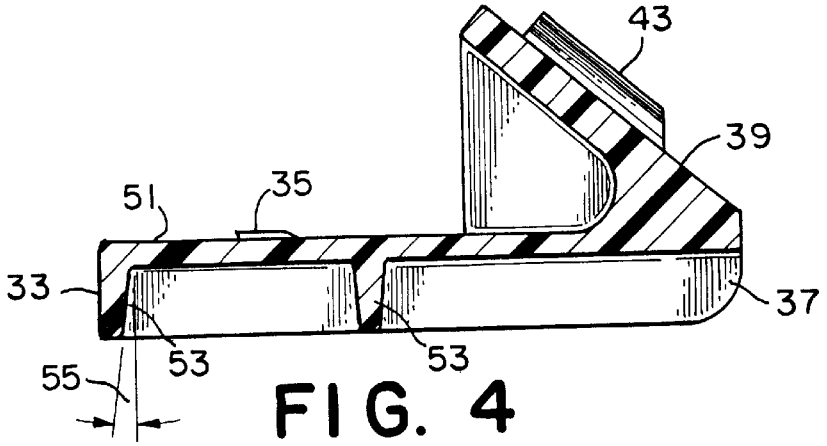
FIG. 4 is a sectional, elevational view of the device taken along the line 4—4 of FIG. 3.

Turning now to the sectioned view shown in FIG. 4, it can be seen that first end 33 includes a center rib 52 supporting cross members 53, each of which is tapered by angle 55, preferably about 50, to permit easy introduction of bracket 27 into the magazine well 29.

In order to demonstrate the efficacy of the present invention, the bracket of this invention was used with 100 and 200 round magazines with the M249 SAW weapon. Satisfactory firing rates were achieved without any problems, and the device was seen to function as designed and with similar efficiency when compared to conventional 30 round magazines. A substantial improvement of fire-power was achieved, affording use of a weapon that is much more effective and versatile than before.

While particular embodiments of the present invention have been illustrated and described herein, it is not intended that these illustrations and descriptions limit the invention. Changes and modifications may be made herein without departing from the scope and spirit of the following claims.

What is claimed is:

1. A device for supporting a munitions magazine for use with a weapon having a magazine well and normally closed cover with a catch thereon, comprising:

a bracket having first end sized to engage said magazine well upon raising said normally closed door, said first end having a slot positioned for engagement of said cover catch upon lowering said door onto said bracket after insertion therein;

a second end on said bracket having a munitions magazine engaging face, said face being aligned with respect to the plane of said bracket at an alignment angle to align said magazine with respect to said magazine well, said face further including slot means for engagement with said munitions magazine, said slots being tapered to permit rapid engagement there between;

said bracket further including a center rib extending from said first end to said second end, said rib including a pair of tapered cross members for engagement with said magazine well;

whereby insertion of said bracket into said well and said munitions magazine into said bracket permits firing of the full capacity of said munitions magazine.

2. The device of claim 1, wherein said weapon is designed to be carried for use while the operator is standing and also provided with a tripod device for ground mounted emplacement and use with said munitions magazine.

3. The device of claim 1, wherein said alignment angle is about 40°.

4. The device of claim 1, wherein said slot means are tapered with an angle of about 5°.

5. The device of claim 1, wherein said cross members are tapered with an angle of about 5°.

6. The device of claim 1, wherein said magazine is a 200 round magazine for a M249 SAW weapon.

* * * * *